US010957238B2

(12) United States Patent
Lim et al.

(10) Patent No.: US 10,957,238 B2
(45) Date of Patent: Mar. 23, 2021

(54) DISPLAY APPARATUS AND CONTROL METHOD THEREOF

(71) Applicant: SAMSUNG ELECTRONICS CO., LTD., Suwon-si (KR)

(72) Inventors: Sungjin Lim, Suwon-si (KR); Arum Lee, Wonju-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/675,933

(22) Filed: Nov. 6, 2019

(65) Prior Publication Data

US 2020/0152111 A1 May 14, 2020

(30) Foreign Application Priority Data

Nov. 8, 2018 (KR) ..... 10-2018-0136911

(51) Int. Cl.
*G09G 3/36* (2006.01)
*G09G 3/20* (2006.01)

(52) U.S. Cl.
CPC ..... *G09G 3/2018* (2013.01); *G09G 3/3688* (2013.01); *G09G 2320/0233* (2013.01)

(58) Field of Classification Search
CPC ..... G09G 3/2018; G09G 3/3688; G09G 2320/0233
See application file for complete search history.

(56) References Cited

U.S. PATENT DOCUMENTS 5,440,269 A 8/1995 Hwang
8,223,176 B2 7/2012 Jeon et al.
2009/0160880 A1 6/2009 Park et al.
(Continued)

FOREIGN PATENT DOCUMENTS

CN 101533611 B * 3/2014
CN 101533611 B 3/2014
CN 107784981 A * 3/2018
(Continued)

OTHER PUBLICATIONS

Written Opinion (PCT/ISA/237) dated Jan. 17, 2020 by the International Searching Authority in counterpart International Application No. PCT/KR2019/012682.
(Continued)

*Primary Examiner* — Robert J Michaud
(74) *Attorney, Agent, or Firm* — Sughrue Mion, PLLC

(57) ABSTRACT

A display apparatus is provided including a display panel, a memory configured to store first image quality compensation data corresponding to a driving frequency of the display panel, and second image quality compensation data corresponding to a frame frequency of an input image to the display panel, the second image quality compensation data corresponding to the first image quality compensation data adjusted based on a luminance value of the input image, and a timing controller configured to, based on the frame frequency of the image input to the display panel being varied, perform image quality compensation on the input image using the second image quality compensation data, and to control the display panel to display the input image based on the image quality compensation.

20 Claims, 7 Drawing Sheets

(56) References Cited

U.S. PATENT DOCUMENTS

2017/0069242 A1 3/2017 Kim et al.

FOREIGN PATENT DOCUMENTS

| | | | |
|---|---|---|---|
| CN | 107784981 | A | 3/2018 |
| JP | 2914556 | B2 | 7/1999 |
| JP | 2016-161499 | A | 9/2016 |
| KR | 10-2009-0069003 | A | 6/2009 |
| KR | 10-2010-0012258 | A | 2/2010 |
| KR | 10-2011-0030212 | A | 3/2011 |
| KR | 10-1461017 | B1 | 11/2014 |
| KR | 10-2016-0086491 | A | 7/2016 |
| KR | 10-1761400 | B1 | 7/2017 |
| KR | 10-2017-0109747 | A | 10/2017 |

OTHER PUBLICATIONS

International Search Report (PCT/ISA/210), dated Jan. 17, 2020 by International Searching Authority in counterpart International Application No. PCT/KR2019/012682.
Communication dated Feb. 25, 2020, issued by the European Patent Office in counterpart European Application No. 19199340.1.

* cited by examiner

DISPLAY APPARATUS AND CONTROL METHOD THEREOF

CROSS-REFERENCE TO RELATED APPLICATION(S)

This application is based on and claims priority under 35 U.S.C. § 119 to Korean Patent Application No. 10-2018-0136911, filed on Nov. 8, 2018, in the Korean Intellectual Property Office, the disclosure of which is incorporated by reference herein in its entirety.

BACKGROUND

1. Field

The disclosure relates to a display apparatus and a controlling method thereof, and more particularly, to a display apparatus for compensating image quality deterioration that occurs as a frequency of an input image changes and a controlling method thereof.

2. Description of Related Art

Generally, a gate-on signal is sequentially applied to a plurality of cells included in a display panel of a display apparatus from a plurality of gate lines, and a data voltage is applied to the cells to which the gate-on signal is applied from a data line. A cell to which a data voltage is applied charges the applied voltage and maintains the voltage of the cell to be constant in order to maintain the brightness of the cell.

In this regard, FIG. 1 is a view explaining a voltage signal applied to a cell of a display panel, and a voltage signal constantly maintained.

For instance, a signal 11 may be a signal for indicating one frame section 31 of an image displayed on a display panel. The one frame section 31 may be determined based on a frequency of an input image. A signal 21 may be a signal for indicating a section 41 in which a data voltage is applied to a display panel, and a section 51 in which the applied data voltage is maintained. A data enable section 41 in which a data voltage is applied may be a section in which a plurality of gate lines are sequentially turned on, and the data enable section 41 may be fixed. A holding section 51 in which the applied data voltage is maintained may be a section, except for the data enable section 41 in the one frame section 31.

Recently, with the development in broadcast and image technology, an image having a variable frequency has been introduced.

Given that a driving frequency of a display panel is fixed, when an image of a variable frequency is input, especially, when a frequency of an image frame is different from a driving frequency of a display panel, image quality deterioration may occur.

To be specific, when a frequency of an image becomes smaller, a time for displaying a single image becomes longer, and thus the length of the one frame section 31 may increase. In addition, although an image having a variable frequency is input, a driving frequency of a display panel could be constant, and thus a gate line of the display panel may be gate-on such that the length of the data enable section 41 in which a data voltage is charged could be constant. In other words, when an image having a variable frequency is input, the length of the holding section 51 may change according to a frequency of an input image frame as the length of the one frame section 31 changes.

In addition, when the charged data voltage is discharged in the holding section 51, the amount of discharged data voltages increases as the length of the holding section 51 increases, and gamma or luminance may be reduced accordingly.

FIG. 2 is a graph illustrating variance of maximum luminance according to a frequency of an input image when a driving frequency of a display panel is constant. The maximum luminance may refer to the largest brightness when an image of a specific frame frequency is displayed. In other words, generally, the maximum luminance may be a brightness when an image having the greatest grayscale value is displayed on a screen.

The maximum luminance value of the image may be related to the amount by which the data voltage charged to the cell is discharged (i.e. the length of a data holding section) for displaying an image frame. Referring to FIG. 1, as the frequency of the image frame becomes smaller, the length of the holding section and the amount of discharged voltages increases, the value of the maximum luminance of the image frame is reduced, and as the frequency of the image frame increases, the length of the data holding section and the amount of discharged voltage is reduced, the maximum luminance value of the image frame is increased.

Therefore, when the frequency of the input image is reduced from $F_2$ to $F_1$, the maximum luminance value of the image displayed on the display panel is reduced.

For example, it is assumed that when the driving frequency of the display panel is $F_2$ Hz, that is, the display panel is optimized to the image frame of $F_2$ Hz, the maximum luminance value is $1_2$. When the image frame of the frequency of $F_1$ Hz, which is a smaller than the frequency of $F_2$ Hz, the holding section of the image frame of the frequency $F_2$ Hz maybe longer than that of the frequency of $F_1$ Hz. Therefore, the maximum luminance value of the frequency of $F_2$ Hz may be reduced to $1_1$ Hz.

Therefore, when the value of the maximum luminance changes according to the change of the frequency of the input image frame, a user may visually recognize an input image as a flicker

SUMMARY

Provided are a display apparatus for compensation image quality deterioration due to image frequency variance by using image compensation data for respective input image frames having different frequencies based on an image having a variable frequency being input, and a controlling method thereof.

In accordance with an aspect of the disclosure, there is provided a display apparatus comprising: a display panel; a memory configured to store first image quality compensation data corresponding to a driving frequency of the display panel, and second image quality compensation data corresponding to a frame frequency of an input image to the display panel, the second image quality compensation data corresponding to the first image quality compensation data adjusted based on a luminance value of the input image; and a timing controller configured to, based on the frame frequency of the image input to the display panel being varied, perform image quality compensation on the input image using the second image quality compensation data, and to control the display panel to display the input image based on the image quality compensation.

The timing controller may be configured to, based on the frame frequency of the image input to the display panel being varied, perform the image quality compensation on the input image using both the first image quality compensation data and the second image quality compensation data.

The luminance value of the input image may comprise a first maximum luminance value corresponding to a first frame frequency at which the input image is displayed through the display panel having the driving frequency, and a second maximum luminance value of the input image corresponding to a second frame frequency at which the input image is displayed through the display panel having the driving frequency.

The second image quality compensation data may be the first image quality compensation data adjusted based on a ratio between the first maximum luminance value and the second maximum luminance value.

The first frame frequency may be smaller than the second frame frequency.

The second frame frequency may be the same as the driving frequency.

The timing controller may be further configured to, based on the frame frequency of the input image comprising a first frame frequency and a second frame frequency, control the display panel to display the input image having the first frame frequency using the second image quality compensation data, and the input image having the second frame frequency using the first image quality compensation data.

The first frame frequency may be smaller than the second frame frequency, and wherein the second frame frequency may be the same the driving frequency.

The timing controller may be further configured to, based on the frame frequency of the image being fixed to a second frame frequency, control the display panel to display the input image using the first image quality compensation data, and wherein the second frame frequency may be the same the driving frequency.

In accordance with an aspect of the disclosure, there is provided a method for controlling a display apparatus including a display panel, the method comprising: receiving an input image to be displayed by the display panel; based on a frame frequency of an image input to the display panel being varied, performing image quality compensation on the input image using a first image quality compensation data corresponding to a frame frequency of the image, among a plurality of pre-stored image quality compensation data, the first image quality compensation data corresponding to a second image quality compensation data adjusted based on a luminance value of the input image, and the second corresponding to a driving frequency of the display panel; and controlling the display panel to display the input image based on the image quality compensation.

The performing of the image quality compensation may comprise, based on the frame frequency of the image input to the display panel being varied, performing the image quality compensation on the input image using both the first image quality compensation data and the second image quality compensation data.

The luminance value of the input image may comprise a first maximum luminance value corresponding to a first frame frequency at which the input image is displayed through the display panel having the driving frequency, and a second maximum luminance value of the input image corresponding to a second frame frequency at which the input image is displayed through the display panel having the driving frequency.

The first image quality compensation data may correspond to the second image quality compensation data adjusted based on a ratio between the first maximum luminance value and the second maximum luminance value.

The first frame frequency may be smaller than the second frame frequency.

The second frame frequency may be the same as the driving frequency.

The controlling the display panel to display may comprise, based on the frame frequency of the input image comprising a first frame frequency and a second frame frequency, controlling the display panel to display the input image having the first frame frequency using the first image quality compensation data, and display the input image having the second frame frequency using the second image quality compensation data.

The first frame frequency may be smaller than the second frame frequency, and the second frame frequency may be the same as the driving frequency.

The method may further comprise: based on the frame frequency of the input image being fixed to a second frame frequency, controlling the display panel to display the input image using the second image quality compensation data.

In accordance with an aspect of the disclosure, there is provided a display apparatus comprising: a memory configured to store one or more instructions; and a processor configured to execute the one or more instructions to: receive an input image to be displayed by a display panel; identify whether the input image is received at a fixed frame frequency or varied frame frequency; adjust the input image using a first compensation data based on the input image being received at the fixed frame frequency; adjust the input image using a second compensation data based on the input image being received at the varied frame frequency; and control the display panel to display the input image adjusted based on the first compensation data or the second compensation data, wherein the second compensation data is determined by adjusting the first compensation data based on a luminance value of the input image.

The input image having the varied frame frequency may comprise a first frame frequency and a second frame frequency, and the second compensation data may be determined by adjusting the first compensation data based on a ratio between a first maximum luminance value corresponding to the first frame frequency and a second maximum luminance value corresponding to the second frame frequency.

The input image having the varied frame frequency may comprise a first frame frequency and a second frame frequency, and a first maximum luminance value corresponding to the first frame frequency and a second maximum luminance value corresponding to the second frame frequency may be adjusted to be equal.

In accordance with an aspect of the disclosure, there is provided a method of controlling a display apparatus, comprising: receiving an input image to be displayed by a display panel; identifying whether the input image is received at a fixed frame frequency or varied frame frequency; adjusting the input image using a first compensation data based on the input image being received at the fixed frame frequency; adjusting the input image using a second compensation data based on the input image being received at the varied frame frequency; and controlling the display panel to display the input image adjusted based on the first compensation data or the second compensation data, wherein the second compensation data is determined by adjusting the first compensation data based on a luminance value of the input image.

The input image having the varied frame frequency may comprise a first frame frequency and a second frame frequency, and the second compensation data may be determined by adjusting the first compensation data based on a ratio between a first maximum luminance value corresponding to the first frame frequency and a second maximum luminance value corresponding to the second frame frequency.

The input image having the varied frame frequency may comprise a first frame frequency and a second frame frequency, and a first maximum luminance value corresponding to the first frame frequency and a second maximum luminance value corresponding to the second frame frequency may adjusted to be equal.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
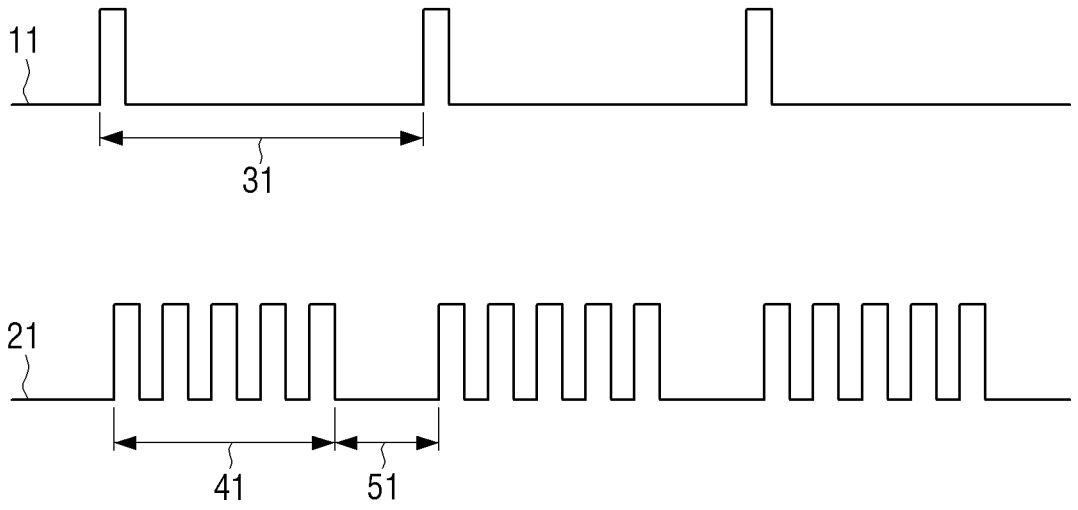
FIG. 1 is a view illustrating a related art display apparatus that receives a variable frequency.

The terms used in this specification will be briefly described, and the disclosure will be described in detail.

All the terms used in this specification including technical and scientific terms have the same meanings as would be generally understood by those skilled in the related art. However, these terms may vary depending on the intentions of the person skilled in the art, legal or technical interpretation, and the emergence of new technologies. In addition, some terms are arbitrarily selected by the applicant. These terms may be construed in the meaning defined herein and, unless otherwise specified, may be construed on the basis of the entire contents of this specification and common technical knowledge in the art.

The disclosure is not limited to embodiments disclosed below and may be implemented in various forms and the scope of the disclosure is not limited to the following embodiments. In addition, all changes or modifications derived from the meaning and scope of the claims and their equivalents should be construed as being included within the scope of the disclosure. In the following description, the configuration which is publicly known but irrelevant to the gist of the disclosure could be omitted.

The terms such as "first," "second," and so on may be used to describe a variety of elements, but the elements should not be limited by these terms. The terms are used simply to distinguish one element from other elements.

The singular expression also includes the plural meaning as long as it does not differently mean in the context. In this specification, terms such as 'include' and 'have/has' should be construed as designating that there are such features, numbers, operations, elements, components or a combination thereof in the specification, not to exclude the existence or possibility of adding one or more of other features, numbers, operations, elements, components or a combination thereof.

In an embodiment, 'a module', 'a unit', or 'a part' perform at least one function or operation, and may be realized as hardware, such as a processor or integrated circuit, software that is executed by a processor, or a combination thereof. In addition, a plurality of 'modules', a plurality of 'units', or a plurality of 'parts' may be integrated into at least one module or chip and may be realized as at least one processor except for 'modules', 'units' or 'parts' that should be realized in a specific hardware.

Hereinafter, embodiments will be described in detail with reference to the accompanying drawings so that those skilled in the art can easily carry out the teachings of the disclosure. However, the disclosure may be embodied in many different forms and is not limited to the embodiments described herein. In order to clearly illustrate the disclosure in the drawings, some of the elements that are not essential to the complete understanding of the disclosure are omitted for clarity, and like reference numerals refer to like elements throughout the specification.

Figure 3:
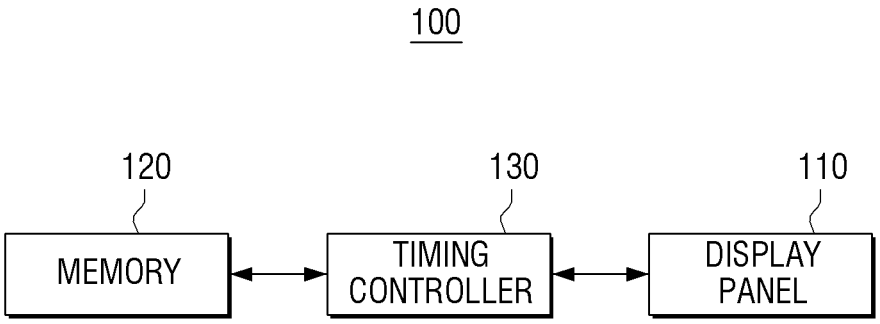
FIG. 3 is a block diagram illustrating a structure of a display apparatus according to an embodiment.

FIG. 3 is a block diagram illustrating a structure of a display of a display apparatus according to an embodiment.

A display apparatus 100 may include a display panel 110, a memory 120, and a timing controller 130.

The display panel 110 may be embodied with a liquid crystal display panel. In this case, the display panel 110 may include a plurality of data lines $DL_1$ to $DL_m$, a plurality of gate lines GL1 to GLn, and a plurality of pixels in which the plurality of data lines $DL_1$ to $DL_m$ cross plurality of gate lines GL1 to GLn. For example, the plurality of data lines $DL_1$ to $DL_m$ and the plurality of gate lines GL1 to GLn are arranged in a matrix form, Each pixel may include a liquid crystal (or, a liquid crystal cell), a Thin Film Transistor (TFT), a liquid crystal capacitor Clc connected to the transistor, and a storage capacitor Cst.

When a gate-on signal (or a gate-on voltage) is applied to a transistor through a gate line, the transistor may be turned on.

The gate-on signal may be applied to a transistor according to the driving frequency of the display panel 110. When the driving frequency of the display panel is 120 Hz, a gate-on signal may be applied to the gate line so that 120 image frames may be displayed every second. That is, the gate-on signal may be applied to the transistor so that a single image frame may be displayed at 1/120 second.

A data voltage according to the grayscale change of an image frame may be applied to a liquid crystal cell connected to the gate line which is gated on by applying a gate signal through a data line. The data voltage may be charged at a liquid crystal capacitor or a storage capacitor via a transistor.

Accordingly, based on the magnitude of the charged data voltage, liquid crystals may be moved and twisted. Moreover, according to the degree of twist of the liquid crystal, a transmittance of light irradiated through a backlight of the display apparatus 100 may be adjusted, and an image frame having a specific grayscale may be displayed through the display panel 100.

The liquid crystal of the display panel 110 may maintain the charged data voltage for a certain period of time. For example, a display panel including 2160 gate lines may apply a gate-on signal and a data voltage to 2160 gate lines sequentially in order to display a single image frame, so that the data voltage may be maintained during a period of time corresponding to 200 gate lines. The period of time for maintaining a data voltage may be referred to as a blank time. The blank time may vary depending on the type of display panel.

The liquid crystal may maintain the charged data voltage based on a period of time corresponding to a single frame of an input frame, and a period of time for charging a data voltage. To be specific, the liquid crystal may maintain the charged data voltage during a time corresponding to the single frame of an input image minus a time for which a data voltage is charged. The time corresponding to the single frame of the input image may vary depending on the frequency of the input image. For example, when the input image is 120 Hz, and the time corresponding to the single frame of the input image may be 1/120 second.

In terms of the characteristic of the liquid crystal included in the display panel 110, while the charged data voltage is maintained, the charged data voltage may be discharged, and image quality compensation may be performed to prevent image quality deterioration due to the discharge of the data voltage.

The memory 120 may store compensation data for performing image quality compensation. To be specific, the memory 120 may store image quality compensation data corresponding to the driving frequency of the display panel and image quality compensation data corresponding to the frame frequency of the image input to the display panel.

The image quality compensation data may include a gamma and color coordinate compensation look-up table (LUT) and a response speed improvement look up table.

The gamma and color coordinate compensation look-up table may include a compensation value of R(Red) data, a compensation value of G(Green) data, and a compensation value of B(Blue) for each grayscale displayed on a display panel. For example, in a display panel that displays grayscales from 0 to 1023, respective compensation values of R data, G data and B data indicating grayscale 0 may be 0, 0, and 0 and respective compensation values of R data, G data and B data indicating grayscale 1023 may be 4080, 4080, and 4080. However, it is merely an example, and the disclosure is not limited thereto. The range of the grayscale to be displayed and the compensation values of R, G and B data may vary depending on the type and characteristic of display panel. In addition, the embodiments are not limited to a single lookup table including the compensation values of R data, G data and B data, instead according to an embodiment a look-up table of R data, a look-up table of G data, and a look-up table of B data may be provided for each grayscale displayed on the display panel.

The response speed improvement look-up table may include a compensation value indicating a grayscale of a present frame during a time for displaying a single frame. When a grayscale of a previous frame is different from a grayscale of a present frame, the liquid crystal of the display may not properly express a grayscale of a present frame during a time for which a display liquid crystal displays a single frame in terms of the response speed characteristic of a display liquid crystal. Therefore, in order to prevent such a problem, an over-driving technique on data of a present frame may be used. For this, the response speed improvement look-up table may be used, and the response speed improvement look-up table may include an over-driving value for indicating a grayscale value of a present frame based on the change of grayscale values of a previous frame and a present frame of the display panel.

Image quality data corresponding to the driving frequency of the display panel, among image quality compensation data stored in the memory 120, may be image quality compensation data applied when the frequency of an image input to the display panel is not variable. That is, when an image having a fixed frequency is input based on the driving frequency of the display panel, the image quality compensation data corresponding to the driving frequency of the display panel may be used.

Image quality compensation data corresponding to the frame frequency of the image input to the display panel, among image quality compensation data stored in the memory 120, may be image quality compensation data applied when the frequency of the image input to the display panel is variable.

The image quality compensation data corresponding to the frame frequency of the image may include first image quality compensation data in which the image quality compensation data corresponding to the driving frequency of the display panel is corrected, and second image quality compensation data corresponding to the image quality compensation data corresponding to the driving frequency of the display panel.

Figure 4:
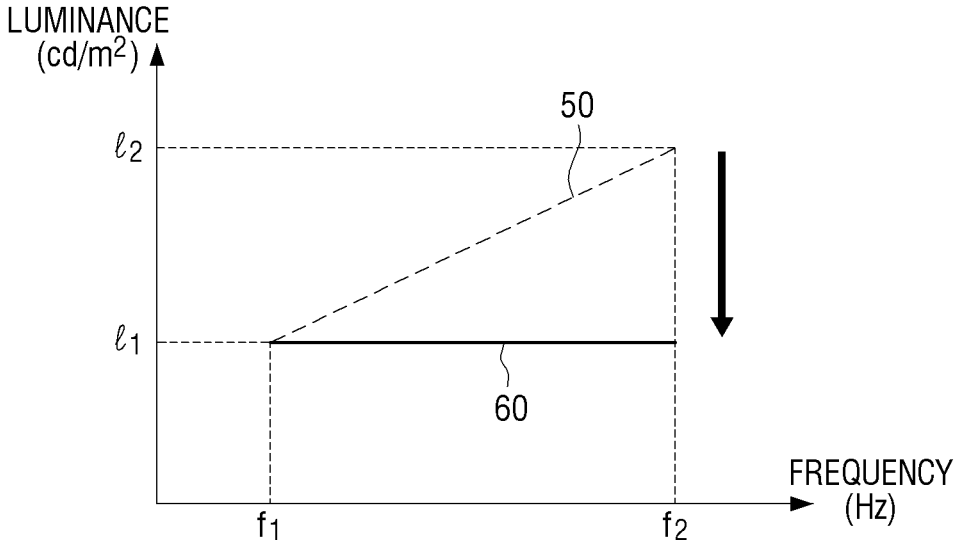
FIG. 4 is a view illustrating a display apparatus according to an embodiment.

FIG. 4 is a view illustrating a display apparatus according to an embodiment. To be specific, FIG. 4 is a view illustrating a display apparatus including the first image quality compensation data in which the image quality compensation data corresponding to the driving frequency of the display panel is corrected.

The luminance of the image may include a first maximum luminance ($l_1$) of an image when the image of a first frame frequency ($f_1$) is displayed through a display panel having a constant driving frequency, and a second maximum luminance ($l_2$) of an image when the image of a second frame frequency ($f_2$) is displayed through a display panel having a driving frequency.

To be specific, the luminance of the image may include the first maximum luminance ($l_1$) of the image when the image of the first frame frequency ($f_1$) is displayed using the image quality compensation data corresponding to the driving frequency of the display panel, and the second maximum luminance ($l_2$) of the image when the image of the second frame frequency ($f_2$) is displayed through a display panel having a driving frequency.

When a single image quality compensation data corresponding to the driving frequency of the display panel is used, the value of the maximum luminance of the image may vary as the frequency of the image changes, and the first maximum luminance ($l_1$) may indicate the smallest maximum luminance value among maximum luminance values of the image that changes according to the change of the frequency of the image, and the second maximum luminance ($l_2$) may indicate the largest maximum luminance value among maximum luminance values of the image that changes according to the change of the frequency of the image.

In other words, the first maximum luminance ($l_1$) may indicate the frequency of the image frame corresponding to the smallest maximum luminance value ($l_1$) within a range of the maximum luminance value that changes according to the change of the image frequency, and the second maximum luminance ($l_2$) may indicate the frequency of the image frame corresponding to the largest maximum luminance value ($l_2$).

Figure 2:
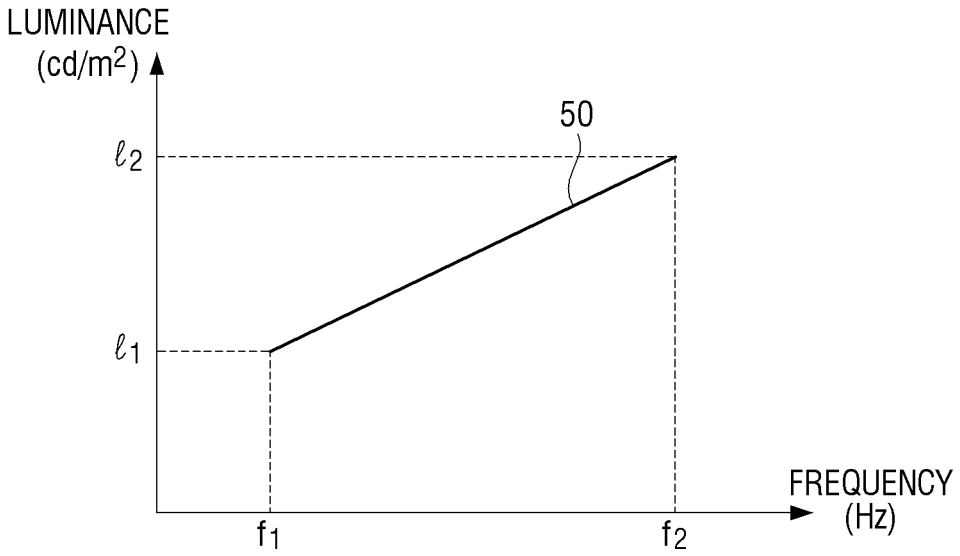
FIG. 2 is a view to illustrating a related art display apparatus that receives a variable frequency.

Referring to FIG. 2, considering that as the frame frequency becomes smaller, the data holding section is extended, and the maximum luminance is reduced. Here, the first frame frequency ($f_1$) may be smaller than the second frame frequency ($f_2$), and the second frame frequency ($f_2$)

may be the same as the driving frequency of the display panel. However, the disclosure is not limited thereto. When an image having a frame frequency larger than the driving frequency of the display panel is input, the second frame frequency ($f_2$) may be greater than the driving frequency of the display panel. When an image having a smaller frame frequency than the driving frequency of the display panel is input, the second frame frequency ($f_2$) may be smaller than the driving frequency of the display panel.

According to an example, the first image quality compensation data may include image quality compensation data corrected based on the first maximum luminance ($l_1$) and the second maximum luminance ($l_2$).

The first image quality compensation data may include image quality compensation data in which image quality compensation data corresponding to the driving frequency of the display panel is reduced based on a ratio between the first maximum luminance ($l_1$) and the second maximum luminance ($l_2$).

For example, it can be assumed that the image quality compensation data corresponding to the driving frequency of the display panel is available as the gamma and color coordinate look-up table, where the gamma and color coordinate look-up table includes compensation values of R, G and B data with respect to grayscale from 0 to 1023. According to an embodiment, the respective compensation values of R, G and B data with respect to a brightest grayscale 1023 may be 4080, 4080, and 4080.

In addition, it can be assumed that an image having a variable frequency (48 to 120 Hz) is input to a display panel, and an image is displayed using image quality compensation data corresponding to the driving frequency of the display panel, the maximum luminance changes within a range of 450 ccd/m$^2$ (i.e., ($l_1$) to 500 ccd/m$^2$ (i.e., ($l_2$)) according to the frequency.

In this case, the smallest value of 450 ccd/m$^2$ within the range of the maximum luminance of the image may be the first maximum luminance ($l_1$), and the largest value of 500 ccd/m$^2$ within the range of the maximum luminance of the image may be the second maximum luminance ($l_2$). In addition, the frame frequency of 48 Hz corresponding to the first maximum luminance value ($l_1$) may be the first frame frequency ($f_1$), and the frame frequency of 120 Hz ($f_2$) corresponding to the second maximum luminance value ($l_2$) may be the second frame frequency (f2).

The first image quality compensation data may include image quality compensation data in which image quality compensation data corresponding to the driving frequency of the display panel is reduced based on a ratio between 450 ccd/m$^2$ and 500 ccd/m$^2$ To be specific, the first image quality compensation data may be image quality compensation data in which the image quality compensation data corresponding to the driving frequency of the display panel is reduced based on the ratio of (the second maximum luminance value ($l_2$)):(the first maximum luminance value ($l_1$)=450:500=9:10. The first image quality compensation data may include a value obtained by multiplying the image compensation data corresponding to the driving frequency of the display panel by 9/10. The image quality compensated first gamma and color coordinate look-up table may indicate the compensation values of R, G and B data with respect to the brightest grayscale as 4080*(9/10)=3672.

When image quality compensation with respect to an image frame having the second frame frequency (f2) is performed using the first image quality compensation data (e.g., the first gamma and color coordinate look-up table), compensation data reduced by 9/10 may be used rather than the case of performing image quality compensation using the image quality compensation data corresponding to the driving frequency of the display panel (e.g., a gamma and look-up table for 120 Hz). In this regard, the maximum luminance of the image frame of 120 Hz that is compensated using the first image quality compensation data may be reduced from 500 ccd/m$^2$ to 450 ccd/m$^2$.

That is, when the second frame frequency is compensated using the first image quality compensation data, the maximum luminance value ($l_2$) of the second frame frequency (f2) may be adjusted to be the same as the maximum luminance value ($l_1$) of the first frame frequency ($f_1$). In this regard, the luminance between the first frame frequency ($f_1$) and the second frame frequency ($f_2$) may be maintained to be the maximum luminance value ($l_1$).

According to an embodiment, when an image having a variable frequency is input to the display panel 110, the graph of the luminance change according to the frame frequency of the image may be from a linear graph 50 with a gradient to a linear graph 60 that is constant. That is, considering that the value of the maximum luminance is constant (i.e., graph 60) even if the frame frequency of the image changes, the image quality of the image frame may be improved, and a user may not visually recognize the flicker of a screen which is being displayed.

According to the embodiment, the image quality compensation data is the gamma and color coordinate look-up table, however, according to another embodiment, a response speed improvement look-up table.

According to an example case, it could be assumed that when the grayscale of the present image frame is the brightest grayscale 1023, the compensation value of the response speed improvement look-up table with respect to the grayscale of the present image frame is 1100.

In addition, it could be assumed that when an image having a variable frequency 48 to 120 Hz is input to a display panel, an image is displayed using the response speed improvement look-up table corresponding to the driving frequency of the display panel, and the maximum frequency changes within the range of 400 ccd/m$^2$ to 500 ccd/m$^2$ according to the frequency.

In this case, the smallest value 400 within the range of the maximum luminance of the image may be the first maximum luminance ($l_1$), the largest value 500 within the range of the maximum luminance of the image may be the second maximum luminance ($l_2$). In addition, the frame frequency of 48 Hz corresponding to the first maximum luminance value may be the first frame frequency ($f_1$), and the frame frequency of 120 Hz corresponding to the second maximum luminance value may be the second frame frequency ($f_2$).

The first response speed improvement look-up table may include a response speed improvement look-up table in which a response speed improvement look-up table corresponding to the driving frequency of the display panel is reduced based on the ratio between 400 ccd/m$^2$ and 500 ccd/m$^2$. The first response speed improvement look-up table in which the response speed improvement look-up table corresponding to the driving frequency of the display panel is reduced may be displayed based on a ratio of (the second maximum luminance value:the first maximum luminance value)=400:500=8:10. The response speed improvement look-up table may include a value obtained by multiplying the response speed improvement look-up table corresponding to the driving frequency of the display by 8/10. The first response speed improvement look-up table in which image quality is compensated may represent the compensation value on the brightest grayscale 1023 as 1100*(8/10)=880.

However, the frequency range of the image frame that can be displayed on the display panel is not limited thereto. That is, the minimum frequency may be smaller than 48 Hz, and the maximum frequency may be larger than 120 Hz, or larger than the driving frequency of the display panel.

The image quality compensation data corresponding to the frame frequency of the image may include the second image quality compensation data corresponding to the driving frequency of the display panel. The second image quality compensation data may have the same value as the image quality compensation data corresponding to the driving frequency of the display panel.

When the variable frequency is input to the display panel, and in the case of the first frame frequency image having the smallest maximum luminance value, the image quality of the first frame frequency image may be compensated using the second image quality compensation data.

According to an embodiment, the image quality compensation data corresponding to the frame frequency of the image may include third image quality compensation data corresponding to a third frame frequency other than the first image quality compensation data and the second image quality compensation data applied to the images of the first frame frequency and the second frame frequency.

To be specific, when a variable image is input to the display panel 110, in order that the maximum luminance value between the first frame frequency ($f_1$) and the second frame frequency ($f_2$) may be the same as the maximum luminance value ($l_1$) of the first frame frequency ($f_1$), the image quality compensation data may include the third image quality compensation data corresponding to the third frame frequency.

The third image quality compensation data corresponding to the third frame frequency may be determined based on the relationship between the first and second frame frequencies and the third frame frequency.

For example, in the case of displaying an image in which a frequency is variable frequency, the third image quality compensation data for rendering the maximum luminance in the third frame frequency may be linearly determined based on the first frame frequency, the second frame frequency, the first image quality compensation data, and the second image quality compensation data.

For example, in the case of the image frame of the third frame frequency, which is a medium value between the first frame frequency ($f_1$) and the second frame frequency ($f_2$), the image quality compensation data may compensate the image quality of the image frame using the third image quality compensation data having the medium value between the first image quality compensation data and the second image quality compensation data.

According to another embodiment, the image quality compensation data may include image quality compensation data generated by giving a weight to a specific frequency. For example, when a luminance is not linear in the third frame frequency between the first frame frequency ($f_1$) and the second frame frequency ($f_2$), the image quality compensation data on the third frame frequency may be separately generated by giving a weight by the luminance change in the third frame frequency.

Referring to FIG. 3, a timing controller 130 may control a display panel to display an input image. To be specific, the timing controller 130 may receive an input image signal, and control a gate driver and a data driver of the display panel 110 so that an input image may be displayed on the display panel 110.

The timing controller 130 may control a gate driver so that a gate-on voltage may be applied to gate lines sequentially to turn on a transistor of a cell connected to the gate line to which the gate-on voltage is applied.

The timing controller 130 may control the data driver to apply a data signal to cells in which a gate-on signal is applied among a plurality of cells of the display panel 110.

When the frequency of the frame of the image input to the display panel 110 is variable, the timing controller 130 may perform image quality compensation on an image through image quality compensation data corresponding to the frame frequency of the image, and control the data driver so that the data signal corresponding to the image quality compensated image may be applied to the display panel 110.

Figure 5:
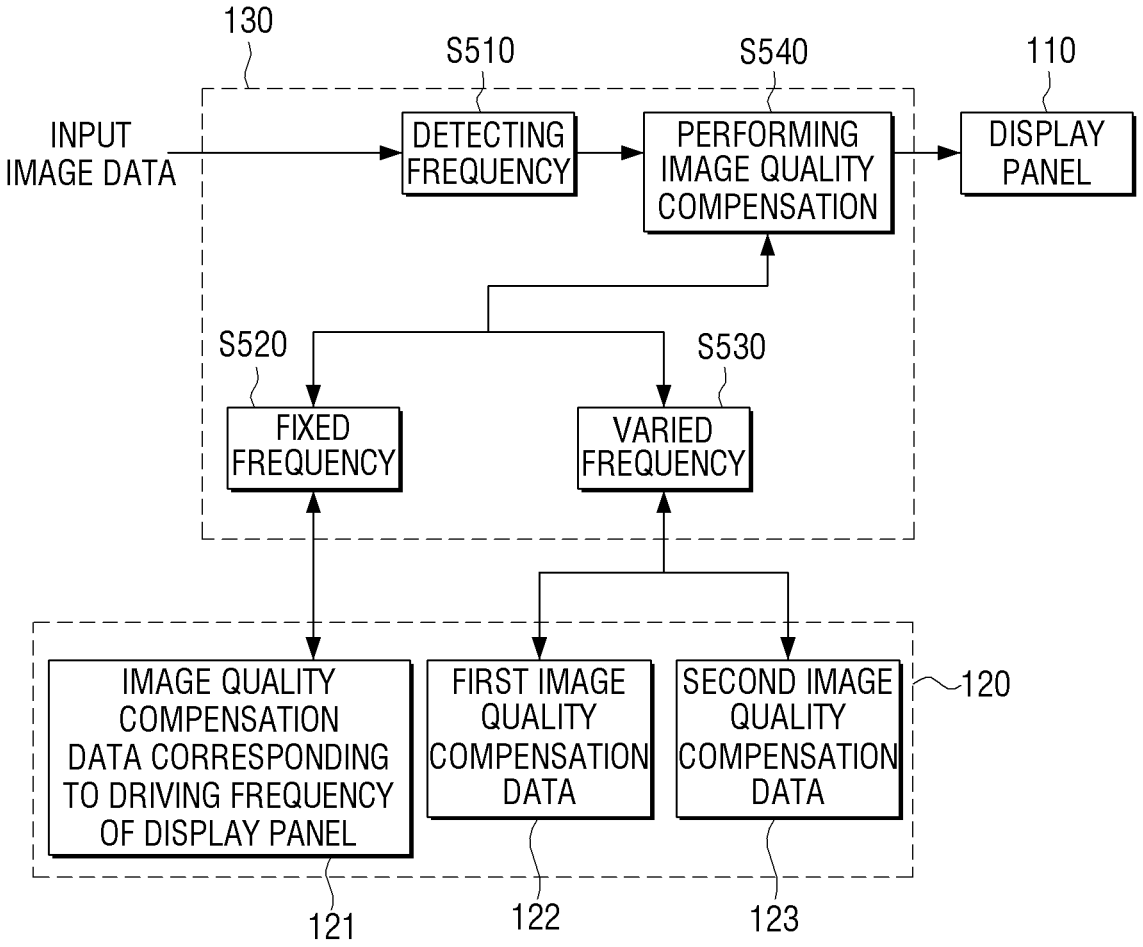
FIG. 5 is a view to illustrating a structure of a display apparatus according to an embodiment.

FIG. 5 is a view illustrating a configuration of a display apparatus according to an embodiment. To be specific, FIG. 5 is a view illustrating an operation of a timing controller according to an embodiment.

In operation S510, the timing controller 130 may detect the frequency of image data when receiving the image data input to the display panel 110. In operation S540, the timing controller 130 may perform compensation on the image data based on whether the detected features of the image data is a fixed frequency (operation S520) or a varied frequency (operation S530). According to an embodiment, the timing controller 130 may use compensation data different from each other depending on whether image data is the fixed frequency or the varied frequency. The timing controller 130 may control a data driver so that the compensated image data may be applied to the cell of the display panel 110. In operation S520, when the frequency of the image data is fixed a particular frame frequency, the timing controller 130 may control the display panel 110 to display the image based on an image quality compensation using image quality compensation data 121 corresponding to the driving frequency of the display panel 110. The particular frame frequency may be the same as the driving frequency of the display panel 110.

In operation S530, when the frequency of the image data input to the display pane 110 is variable, the timing controller 130 may control a data driver to compensate image quality of an input image using first image quality compensation data 122 and second image quality compensation data 123 among image quality compensation data pre-stored in the memory 120 and to allow the compensated input image data signal to be applied.

Referring to FIG. 4, when an image is displayed on a screen, the first image quality compensation data 122 may represent image quality compensation data applied to the second frame frequency so that the image of the second frame frequency ($f_2$) having the maximum luminance value ($l_2$) may have the first maximum luminance value ($l_1$) corresponding to the first frame frequency ($f_1$).

The second image quality compensation data 123 may be image quality compensation data applied to the first frame frequency ($f_1$) having the smallest maximum luminance value ($l_1$) when an image is displayed on a screen, and may have the same value as the image quality compensation data 121 corresponding to the driving frequency of the display panel.

The timing controller 130 may apply different compensation data to image frames according to the frequency of the input image frame.

When the frame frequency of the image is variable and the frame frequency of the image includes a first frame frequency and a second frame frequency, the timing controller 130 may control the display panel 110 to display the image of the first frame frequency through the second image quality compensation data among the image quality compensation data, and display the image of the second frame frequency through the first image compensation data among the image quality compensation data.

The timing controller 130 may identify the frequency of the input image frame, and determine compensation data to be applied to perform image quality compensation on the image frame based on the determined frequency of the image frame.

According to an embodiment, the timing controller 130 may compensate image quality by applying the first image quality compensation data on a frame frequency equal to or more than the first frame frequency, and less than a frequency calculated by the following equation 1: {(the first frame frequency+the second frame frequency/2}, and compensate image quality by applying the second image quality compensation data on a frame frequency equal to or more than the frequency calculated by equation 1 (i.e., {(the first frame frequency+the second frame frequency)/2}), and equal to or less than the second frame frequency.

According to an another embodiment, the timing controller 130 may compensate image quality by applying the first image quality compensation data on a frame frequency more than the first frame frequency, and less than or equal to the second frame frequency, and compensate image quality by applying the second image quality compensation data on a frame frequency equal to the first frame frequency.

Referring to FIG. 5, it is illustrated that the memory 120 includes first and second image quality compensation data 122 and 123 as image quality compensation data used when a frequency is varied. However, according to an embodiment, the third image compensation data on a random frequency between the first frequency and the second frequency of the input image frame may be further included. In addition, the frequency range of the image frame to which the first to third image quality compensation data is applied may vary. For example, when an image having a variable frequency is input to the display panel 110, it is assumed that the first maximum luminance value is 450 ccd/$m^2$, the value of the second maximum luminance is 500 ccd/$m^2$, the first frame frequency corresponding to the first maximum luminance is 48 Hz, and the second frame frequency corresponding to the second maximum luminance is 120 Hz.

The memory 120 may further include the third image quality compensation data corrected based on the maximum luminance value in the third frame frequency (84 Hz), which is a medium value between the first and second frame frequencies and the first maximum luminance value.

The timing controller 130 may use the second image quality compensation data on the image having a frame frequency equal to or more than 48 Hz and less than 66(=(48 Hz+84 Hz)/2) Hz, use the third image quality compensation data on the image having a frame frequency equal to or more than 66(=(48 Hz+84 Hz)/2) Hz and less than 102(=(84 Hz+120 Hz)/2) Hz, and use the first image quality compensation data on the image having a frequency equal to or more than 102(=(84 Hz+120 Hz)/2) Hz and less than 120 Hz to perform image compensation.

However, the disclosure is not limited thereto. The number of image quality compensation data applied to the input image in which a frequency is varied and the range of the frequency to which the image quality compensation data is applied may vary depending on an embodiment.

Figure 6:
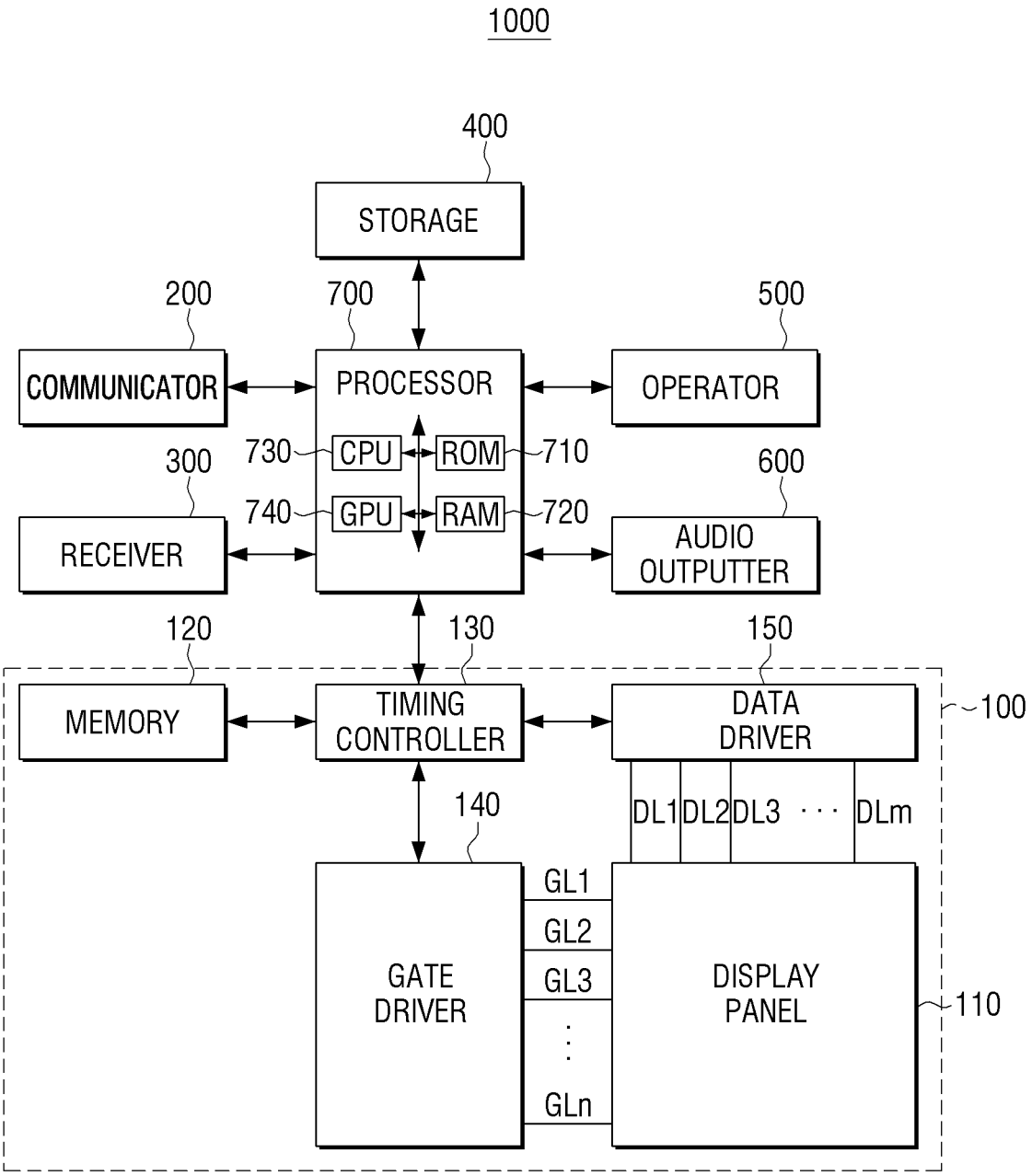
FIG. 6 is a block diagram illustrating a detailed configuration of a display apparatus according to an embodiment.

FIG. 6 is a block diagram illustrating a detailed configuration of a display apparatus according to an embodiment.

Referring to FIG. 6, a display apparatus 1000 may include a display 100 comprising a display panel 110, a memory 120, a timing controller 130, a gate driver 140, and a data driver 150, a communicator 200, a receiver 300, a storage 400, an operator 500, an audio outputter 600 and a processor 700.

Referring to FIG. 6, the description of the display panel 110, the memory 120, and the timing controller 130 is the same as those in FIG. 1, and thus a detailed description thereof will be omitted.

The gate driver 140 may sequentially apply a gate-on voltage to a plurality of gate lines GL1 to GLn of a display panel, and turn on a thin film transistor in which a gate electrode is connected to a gate electrode to which a gate-on voltage is applied.

The data driver 150 may receive a data signal from the timing controller 130, and apply a data voltage corresponding to the received data voltage to a plurality of data lines DL1 to DLm of a display panel.

The timing controller 130 may control the gate driver 140 and the data driver 150 so that the display panel 110 displays an image frame.

The communicator 200 may perform communication with an external device. The communicator 200 may transmit and receive various data to and from the external device.

The communicator 200 may perform communication with an external device using various types of communication methods. For example, by using a communication module, the communicator 200 may perform communication with the external device according to communication standards such as Bluetooth, Wi-Fi, etc.

The receiver 300 may receive broadcast from a broadcasting station or satellite in a wired or wireless manner and demodulate the broadcast. The receiver 300 may receive a transmission stream through antenna or cable and demodulate the transmission stream to output a digital transmission stream signal. The receiver 300 may be configured to include a tuner and a demodulator. However, it is only exemplary, and the disclosure is not limited thereto. The receiver 300 may be embodied in various forms according to an embodiment.

The storage 400 may store image contents. The storage 400 may be provided with image contents in which image and audio are compressed from an audio processor and a video processor, and store the image contents. The storage 400 may output the stored image contents to the audio processor and the video processor under the control of the processor 700. The storage 400 may be embodied with hard disk, a non-volatile memory, a volatile memory, etc.

The operator 500 may be embodied with a touch screen, a touch pad, a key button, a key pad, etc., to provide user operation of the display apparatus 1000. According to an embodiment, it will be exemplified that a control command is received through the operator 500 included in the display apparatus 1000, but the operator 500 may receive a user operation from an external control device (e.g., a remote controller).

The audio outputter 600 may perform signal processing such as decoding on audio data input from the receiver 300 and the storage 400, and output the audio data. The audio outputter 600 may be embodied as a speaker, etc.

The processor 700 may control the overall operation of the display apparatus 1000. The processor 700 may identify whether a frame frequency of an input image input to the display apparatus 1000 is varied. In addition, the processor 700 may transmit a result of determination on whether the frame frequency of the image is varied to the timing controller 130.

The processor 700 may control hardware or software constituent elements connected to the processor 700 by driving an operation system or an application program, and perform various data processing and operations. In addition, the processor 700 may load commands or data received from at least one of other constituent elements to a volatile memory and process the commands or data and store various data in a non-volatile memory.

The processor 700 may execute at least one software program stored in a processor for performing the operation (e.g., an embedded processor) or a memory device, and may be embodied as a general purpose processor for performing the operations (e.g., a CPU or an application processor).

The processor 700 may transmit image data received from the external device through the communicator 200 to a display panel (110) or store the image data in the storage 400. The processor 700 may perform signal processing such as decoding on image data input from the receiver 300 and the storage 400, and output the image data to the timing controller 130.

The processor 700 may include a ROM 710, a RAM 720, a CPU 730, a graphic processing unit (GPU) 740, and a bus. The ROM 710, the RAM 720, the CPU 730, the graphic processing unit (GPU) 740, etc. may be connected to one another through the bus.

The main CPU 730 may access the storage 400, and perform booting by using the O/S stored in the storage 400. The main CPU 730 may perform various operations by using various programs, contents data, etc. stored in the storage 400. The operation of the CPU 730 is the same as that of the processor 700 described above. Therefore, a detailed description thereof will be omitted.

The ROM 710 may store a command set, etc. for system booting. If a turn-on command is input and power is supplied, the CPU 730 may copy the operation system stored in the storage 400 to the RAM 720 according to the command stored in the ROM 710, execute the operation system and perform booting of the system. When the booting is completed, the CPU 730 may copy various programs stored in the storage 400 to the RAM 720, execute the application program copied to the RAM 720 and perform various operations.

The GPU 740 may generate a screen including various objects such as icons, images, texts, etc. when booting of the display apparatus 1000 is completed.

According to the above-described example, the processor 700 may be included in a main board, and the timing controller 130 may be included in a TCON (Timer/Counter Control Register) board. When the main board and the TCON board are integrally embodied, the processor 700 and the timing controller 130 may be included in the same board.

Figure 7:
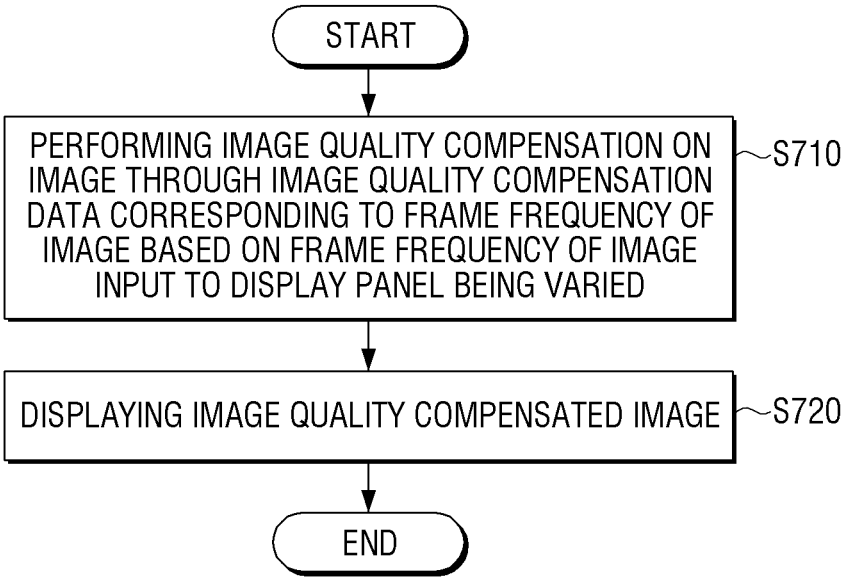
FIG. 7 is a flowchart illustrating a method for controlling a display apparatus according to an embodiment.

FIG. 7 is a view illustrating a method for controlling a display apparatus according to an embodiment.

In operation S710, image quality compensation on an input image may be performed through the image quality compensation data corresponding to the frame frequency of the image, when the frame frequency of the image input to the display panel is varied. The image quality compensation data corresponding to the frequency of the image may include the first image quality compensation data in which the image quality compensation data corresponding to the driving frequency of the display panel is corrected based on the luminance of the image.

The luminance of the image may include a first maximum luminance of the image when the image of a first frame frequency is displayed through the display panel having a driving frequency and a second maximum luminance of the image when the image of a second frame frequency is displayed through the display panel having the driving frequency.

The first image quality compensation data may include image quality compensation data in which the first image quality compensation data corresponding to the driving frequency of the display panel is reduced based on the ratio between the first maximum luminance and the second maximum luminance.

The first frame frequency may be smaller than the second frame frequency, and the second frame frequency may be the same as the driving frequency of the display panel.

In operation S720, the display apparatus may display the image quality compensated image. To be specific, when the frame frequency of the input image is varied, and the frame frequency of the input image includes the first frame frequency and the second frame frequency, the display apparatus may display the input image of the first frame frequency through the corrected second image quality compensation data among pre-stored image quality compensation data.

The first frame frequency may be smaller than the second frame frequency, and the second frame frequency may be the same as the driving frequency of the display panel.

When the frame frequency of the input image is fixed to the second frame frequency, the input image of the second frame frequency may be displayed through the image quality compensation data corresponding to the driving frequency of the display panel among pre-stored image quality compensation data. In this case, the second frame frequency may be the same as the driving frequency of the display panel.

The various embodiments described above can be implemented in a recording medium that can be read by a computer or a similar device using software, hardware, or a combination thereof. According to a hardware implementation, the embodiments described in this disclosure may be implemented as application specific integrated circuits (ASICs), digital signal processors (DSPs), digital signal processing devices (DSPDs), programmable logic devices (PLDs) programmable gate arrays, a processor, a controller, a micro-controller, a microprocessor, and an electrical unit for performing other functions. In some cases, the embodiments described herein may be implemented by processor itself. According to software implementation, embodiments such as the procedures and functions described herein may be implemented in separate software modules. Each of the software modules may perform one or more of the functions and operations described herein.

Computer instructions for performing a processing operations of a device in accordance with various embodiments described above may be stored in a non-transitory computer-readable medium. The computer instructions stored in the non-volatile computer-readable medium cause a particular device to perform the processing operation on the device according to various embodiments described above when executed by the processor of the particular device.

The non-transitory computer readable medium refers to a medium that stores data semi-permanently rather than storing data for a very short time, such as a register, a cache, and a memory, and is readable by an apparatus. Specifically, the above-described various applications or programs may be stored in a non-transitory computer readable medium such as a compact disc (CD), a digital versatile disk (DVD), a hard disk, a Blu-ray disk, a universal serial bus (USB) memory stick, a memory card, and a read only memory (ROM), and may be provided.

Although embodiments have been shown and described, it will be appreciated by those skilled in the art that changes may be made to these embodiments without departing from the principles and spirit of the disclosure. Accordingly, the scope of the disclosure is not construed as being limited to the described embodiments, but is defined by the appended claims as well as equivalents thereto.

What is claimed is:

1. A display apparatus comprising:

a display panel;

a memory configured to store first image quality compensation data corresponding to a driving frequency of the display panel, and second image quality compensation data corresponding to a frame frequency of an input image to the display panel, the second image quality compensation data corresponding to the first image quality compensation data adjusted based on a luminance value of the input image; and a timing controller configured to, based on the frame frequency of the image input to the display panel being varied:

identify whether the varied frame frequency satisfies a first condition or a second condition, based on the varied frame frequency satisfying the first condition, perform image quality compensation on the input image using the second image quality compensation data, based on the varied frame frequency satisfying the second condition, perform image quality compensation on the input image using an image quality compensation data different from the second image quality compensation data, and control the display panel to display the input image based on the image quality compensation.

2. The display apparatus as claimed in claim 1, wherein the timing controller is configured to, based on the frame frequency of the image input to the display panel being varied, perform the image quality compensation on the input image using both the first image quality compensation data and the second image quality compensation data.

3. The display apparatus as claimed in claim 1, wherein the luminance value of the input image comprises a first maximum luminance value corresponding to a first frame frequency at which the input image is displayed through the display panel having the driving frequency, and a second maximum luminance value of the input image corresponding to a second frame frequency at which the input image is displayed through the display panel having the driving frequency.

4. The display apparatus as claimed in claim 3, wherein the second image quality compensation data is the first image quality compensation data adjusted based on a ratio between the first maximum luminance value and the second maximum luminance value.

5. The display apparatus as claimed in claim 3, wherein the first frame frequency is smaller than the second frame frequency.

6. The display apparatus as claimed in claim 3, wherein the second frame frequency is the same as the driving frequency.

7. The display apparatus as claimed in claim 2, wherein the timing controller is further configured to, based on the frame frequency of the input image comprising a first frame frequency and a second frame frequency, control the display panel to display the input image having the first frame frequency using the second image quality compensation data, and the input image having the second frame frequency using the first image quality compensation data.

8. The display apparatus as claimed in claim 7, wherein the first frame frequency is smaller than the second frame frequency, and wherein the second frame frequency is the same the driving frequency.

9. The display apparatus as claimed in claim 1, wherein the timing controller is further configured to, based on the frame frequency of the input image being fixed to a second frame frequency, control the display panel to display the input image using the first image quality compensation data, and wherein the second frame frequency is the same the driving frequency.

10. The display apparatus of claim 1, wherein the first condition is satisfied when the varied frequency is equal to or greater than a first frequency and less than an average of the first frequency and a second frequency, and wherein the second condition is satisfied when the varied frequency is equal to or greater than the average of the first frequency and the second frequency and less than the second frequency.

11. The display apparatus of claim 1, wherein the first condition is satisfied when the varied frequency is greater than a first frequency and less than or equal to a second frequency, and wherein the second condition is satisfied when the varied frequency is equal to the first frequency.

12. The display apparatus of claim 1, wherein the first image quality compensation data corresponds to an image quality compensation data applied based on the frequency of the image input to the display panel being constant.

13. A method for controlling a display apparatus including a display panel, the method comprising:

receiving an input image to be displayed by the display panel;

based on a frame frequency of an image input to the display panel being varied:

identifying whether the varied frame frequency satisfies a first condition or a second condition, based on the varied frame frequency satisfying the first condition, performing image quality compensation on the input image using a first image quality compensation data corresponding to the frame frequency of the image, among a plurality of pre-stored image quality compensation data, the first image quality compensation data corresponding to a second image quality compensation data adjusted based on a luminance value of the input image, and the second image quality compensation data corresponding to a driving frequency of the display panel;

based on the varied frame frequency satisfying the second condition, performing image quality compensation on the input image using an image quality compensation data different from the first image quality compensation data, and controlling the display panel to display the input image based on the image quality compensation.

14. The method as claimed in claim 13, wherein the performing of the image quality compensation comprises, based on the frame frequency of the image input to the display panel being varied, performing the image quality compensation on the input image using both the first image quality compensation data and the second image quality compensation data.

15. The method as claimed in claim 13, wherein the luminance value of the input image comprises a first maximum luminance value corresponding to a first frame frequency at which the input image is displayed through the display panel having the driving frequency, and a second maximum luminance value of the input image corresponding to a second frame frequency at which the input image is displayed through the display panel having the driving frequency.

16. The method as claimed in claim 15, wherein the first image quality compensation data corresponds to the second image quality compensation data adjusted based on a ratio between the first maximum luminance value and the second maximum luminance value.

17. The method as claimed in claim 15, wherein the first frame frequency is smaller than the second frame frequency.

18. The method as claimed in claim 15, wherein the second frame frequency is the same as the driving frequency.

19. The method as claimed in claim 14, wherein the controlling the display panel to display comprises, based on the frame frequency of the input image comprising a first frame frequency and a second frame frequency, controlling the display panel to display the input image having the first frame frequency using the first image quality compensation data, and display the input image having the second frame frequency using the second image quality compensation data.

20. The method as claimed in claim 19, wherein the first frame frequency is smaller than the second frame frequency, and wherein the second frame frequency is the same as the driving frequency.

* * * * *